US012560372B2

(12) United States Patent
Wang

(10) Patent No.: US 12,560,372 B2
(45) Date of Patent: Feb. 24, 2026

(54) REFRIGERATOR COOLING SYSTEM AND METHOD FOR DEFROSTING REFRIGERATOR

(71) Applicants: HEFEI MIDEA REFRIGERATOR CO., LTD., Anhui (CN); HEFEI HUALING CO., LTD., Anhui (CN); MIDEA GROUP CO., LTD., Guangdong (CN)

(72) Inventor: Jindong Wang, Anhui (CN)

(73) Assignees: HEFEI MIDEA REFRIGERATOR CO., LTD., Hefei (CN); HEFEI HUALING CO., LTD., Hefei (CN); MIDEA GROUP CO., LTD., Foshan (CN)

( * ) Notice: Subject to any disclaimer, the term of this patent is extended or adjusted under 35 U.S.C. 154(b) by 216 days.

(21) Appl. No.: 18/003,664

(22) PCT Filed: Sep. 27, 2021

(86) PCT No.: PCT/CN2021/120991
§ 371 (c)(1),
(2) Date: Dec. 28, 2022

(87) PCT Pub. No.: WO2022/111035
PCT Pub. Date: Jun. 2, 2022

(65) Prior Publication Data

US 2023/0288122 A1 Sep. 14, 2023

(30) Foreign Application Priority Data

Nov. 30, 2020 (CN) ..... 202011384417.4

(51) Int. Cl.
*F25D 21/00* (2006.01)

(52) U.S. Cl.
CPC ..... *F25D 21/004* (2013.01)

(58) Field of Classification Search
CPC ..... F25D 21/004; F25D 21/12; F25B 47/022
See application file for complete search history.

(56) References Cited

U.S. PATENT DOCUMENTS 4,565,070 A 1/1986 Raymond
2012/0023975 A1 2/2012 Yoon et al.
(Continued)

FOREIGN PATENT DOCUMENTS

CN 101509718 A 8/2009
CN 204787467 U 11/2015
(Continued)

OTHER PUBLICATIONS

He et al. (CN206488502U), English Translation, Air conditioning unit, 2017, Whole document (Year: 2017).*
(Continued)

*Primary Examiner* — Jerry-Daryl Fletcher
*Assistant Examiner* — Keith Stanley Myers
(74) *Attorney, Agent, or Firm* — K&L Gates LLP

(57) ABSTRACT

A refrigerator cooling system includes a refrigerant circulation flow path provided with a compressor, a condenser, a throttling device and an evaporator. The evaporator includes a heat exchange core tube including a main inlet, a main outlet and at least one middle inlet. The refrigerant circulation flow path includes a first flow path section. The defrosting branch is connected among the exhaust port of the compressor, the main inlet and the middle inlet. The switching device is for switching the defrosting branch to communicate the exhaust port of the compressor with at least one of the main inlet and the middle inlet, and is further for switching the first flow path section to be communicated.

13 Claims, 9 Drawing Sheets

(56) References Cited

U.S. PATENT DOCUMENTS

| | | | | |
|---|---|---|---|---|
| 2018/0106505 | A1* | 4/2018 | Mislak | F25B 5/00 |
| 2022/0099375 | A1* | 3/2022 | Khaire | F28F 1/006 |

FOREIGN PATENT DOCUMENTS

| | | | | | |
|---|---|---|---|---|---|
| CN | 106403466 | A | | 2/2017 | |
| CN | 106440462 | A | | 2/2017 | |
| CN | 107152820 | A | * | 9/2017 | F25B 47/025 |
| CN | 206488502 | U | | 9/2017 | |
| CN | 208704226 | U | | 4/2019 | |
| CN | 111520942 | A | | 8/2020 | |
| DE | 102019200673 | A1 | | 7/2020 | |
| WO | WO 2015149840 | A1 | | 10/2015 | |
| WO | WO 2019200448 | A1 | | 10/2019 | |

OTHER PUBLICATIONS

Fu et al. (CN107152820A), English Translation, Air conditioner and control method thereof, 2017, Whole document (Year: 2017).*

* cited by examiner

REFRIGERATOR COOLING SYSTEM AND METHOD FOR DEFROSTING REFRIGERATOR

CROSS-REFERENCE TO RELATED APPLICATIONS

This application claims priority to Chinese Patent Application No. 202011384417.4, filed on Nov. 30, 2020, the entire contents of which are incorporated herein by reference.

BACKGROUND

Technical Field

The present disclosure relates to the technical field of refrigerators, in particular to a refrigerator cooling system and a method for defrosting a refrigerator.

Description of the Related Art

When the evaporator in the refrigerator is frosted, the thickness of the frost layer is not uniform. The current defrosting technology mainly uses heating devices such as heating tubes to heat the evaporator, which is difficult to accurately defrost, resulting in waste of heat.

BRIEF SUMMARY

The present disclosure provides a refrigerator cooling system and a method for defrosting a refrigerator, which optimizes the cooling system of the refrigerator, save electric energy and improve the user experience.

The present disclosure provides a refrigerator cooling system, including a refrigerant circulation flow path provided with a compressor, a condenser, a throttling device and an evaporator, a defrosting branch and a switching device. The evaporator includes a heat exchange core tube, the heat exchange core tube includes a main inlet communicated with the throttling device and a main outlet communicated with the compressor, a middle section of the heat exchange core tube is provided with at least one middle inlet, a section of the refrigerant circulation flow path between an exhaust port of the compressor and the main inlet of the evaporator is a first flow path section, both the condenser and the throttling device are located on the first flow path section.

The defrosting branch is connected among the exhaust port of the compressor, the main inlet and the at least one middle inlet, the switching device is for switching the defrosting branch to communicate the exhaust port of the compressor with at least one of the main inlet and the at least one middle inlet, to enter a defrosting working mode, and the switching device is further for switching the first flow path section to be in a circulating state, to enter a cooling working mode.

In an embodiment, the defrosting branch has one input port and a plurality of output ports, the input port is connected between the exhaust port of the compressor and the condenser, the plurality of output ports are respectively provided corresponding to the main inlet and at least one middle inlet.

The switching device includes a first switching device and a second switching device, the first switching device is for switching at least one of the plurality of output ports to communicate with one of the main inlet and the at least one middle inlet, and the second switching device is for switching one of the input port and the first flow path section to communicate with the exhaust port of the compressor.

In an embodiment, the first switching device includes a first three-way valve, the first three-way valve is formed with three first communication ports that communicate with each other, two of the three first communication ports are connected in series between the defrosting branch and the main inlet, and the other first communication port is connected to one of the middle inlets.

In an embodiment, the middle section of the heat exchange core tube is provided with a plurality of middle inlets, the first switching device includes a plurality of first three-way valves, two first communication ports of each of the plurality of first three-way valves are connected in series between the defrosting branch and the main inlet, and the other communication ports of the plurality of first three-way valves are correspondingly connected to the plurality of middle inlets.

In an embodiment, the first three-way valve is an electromagnetic three-way valve.

In an embodiment, the second switching device includes a second three-way valve, the second three-way valve is formed with three second communication ports that communicate with each other, a first one of the three second communication ports is communicated with the first flow path section, a second one of the three second communication ports is communicated with the exhaust port of the compressor, and a third one of the three second communication ports is communicated with the defrosting branch.

In an embodiment, the second three-way valve is an electromagnetic three-way valve.

In an embodiment, the switching device is an electrical switching device, and the refrigerator cooling system further includes: a temperature sensor for detecting a surface temperature of the evaporator; and a control assembly electrically connected to the temperature sensor and the electrical switching device, for switching a working mode of the refrigerator cooling system according to a temperature obtained by the temperature sensor.

In an embodiment, the at least one middle inlet is configured to divide the heat exchange core tube into a plurality of heat exchange sections, and a plurality of the temperature sensors are provided corresponding to the plurality of the heat exchange sections.

The present disclosure further provides a method for defrosting a refrigerator applied to a refrigerator cooling system. The refrigerator cooling system includes a refrigerant circulation flow path provided with a compressor, a condenser, a throttling device and an evaporator, a defrosting branch and a switching device. The evaporator includes a heat exchange core tube, the heat exchange core tube includes a main inlet communicated with the throttling device and a main outlet communicated with the compressor, a middle section of the heat exchange core tube is provided with at least one middle inlet, a section of the refrigerant circulation flow path between an exhaust port of the compressor and the main inlet of the evaporator is a first flow path section, both the condenser and the throttling device are located on the first flow path section.

The defrosting branch is connected among the exhaust port of the compressor, the main inlet and the at least one middle inlet, the switching device is for switching the defrosting branch to communicate the exhaust port of the compressor with at least one of the main inlet and the at least one middle inlet, to enter a defrosting working mode, and the switching device is further for switching the first flow path section to be in a circulating state, to enter a cooling working mode.

The defrosting working mode includes a full defrosting mode and at least one partial defrosting mode, in response to the refrigerator cooling system being in the full defrosting mode, the defrosting branch is communicated with the exhaust port of the compressor and is provided corresponding to the main inlet, in response to the refrigerator cooling system being in the partial defrosting mode, the defrosting branch is communicated with the exhaust port of the compressor and is provided corresponding to the middle inlet.

The method for defrosting the refrigerator includes following operations: obtaining a first working parameter of the refrigerator cooling system in response to the refrigerator cooling system being in the cooling working mode; and switching the refrigerator cooling system to enter the full defrosting mode and the partial defrosting mode according to the first working parameter.

In an embodiment, the first working parameter is an actual working duration parameter T, and the operation of switching the refrigerator cooling system to enter the full defrosting mode and the partial defrosting mode according to the first working parameter includes: when T is equal to T2, switching the refrigerator cooling system to enter the partial defrosting mode, and when a preset condition is reached, switching the refrigerator cooling system from the partial defrosting mode to the cooling working mode, T2 is a preset cooling duration for partial defrosting; and when T is equal to T1, switching the refrigerator cooling system to enter the full defrosting mode, wherein T1 is a preset cooling duration period for full defrosting, and T1 is greater than T2.

In an embodiment, a plurality of middle inlets are provided, the plurality of middle inlets include a first middle inlet away from the main inlet and a second middle inlet adjacent to the main inlet, the partial defrosting mode includes a first partial defrosting mode and a second partial defrosting mode, in response to the refrigerator cooling system being in the first partial defrosting mode, the defrosting branch is communicated with the exhaust port of the compressor and the first middle inlet, in response to the refrigerator cooling system being in the second partial defrosting mode, the defrosting branch is communicated with the exhaust port of the compressor and the second middle inlet.

The operation of, when T is equal to T2, switching the refrigerator cooling system to enter the partial defrosting mode, and when the preset condition is reached, switching the refrigerator cooling system from the partial defrosting mode to the cooling working mode includes: when T is equal to T21, switching the refrigerator cooling system to enter the first partial defrosting mode, and when the preset condition is reached, switching the refrigerator cooling system from the first partial defrosting mode to the cooling working mode, wherein T21 is a preset cooling duration for a first partial defrosting, and T21 is less than T1; and when T is equal to T22, switching the refrigerator cooling system to enter the second partial defrosting mode, and when the preset condition is reached, switching the refrigerator cooling system from the second partial defrosting mode to the cooling working mode, wherein T22 is a preset cooling duration for a second partial defrosting, and T22 is less than T1 and greater than T21.

In an embodiment, the operation of when T is equal to T2, switching the refrigerator cooling system to enter the partial defrosting mode, and when the preset condition is reached, switching the refrigerator cooling system from the partial defrosting mode to the cooling working mode further includes: obtaining a second working parameter of the refrigerator cooling system, wherein the preset condition is that the second working parameter reaches a preset parameter value.

In an embodiment, the second working parameter is an actual temperature parameter t of the evaporator, the preset condition is that t is equal to t1, and t1 is a preset temperature value.

In an embodiment, the first working parameter and/or the second working parameter includes a temperature parameter and a working duration parameter.

In technical solutions of the present disclosure, the heat exchange core tube of the evaporator includes a main inlet communicated with the throttling device and a main outlet communicated with the compressor. A middle section of the heat exchange core tube is provided with at least one middle inlet. A section of the refrigerant circulation flow path between an exhaust port of the compressor and the main inlet of the evaporator is a first flow path section. The defrosting branch is connected among the exhaust port of the compressor, the main inlet and the at least one middle inlet. When the refrigerator cooling system is normally cooling, the switching device switches the first flow path section to be in a circulating state. When the refrigerator cooling system is defrosting, the switching device switches the defrosting branch to communicate the exhaust port of the compressor with at least one of the main inlet and the at least one middle inlet. When the exhaust port of the compressor is communicated with the main inlet, the entire heat exchange core tube is defrosted. When the exhaust port of the compressor is communicated with the at least one middle inlet, the heat exchange core tube is defrosted in part. Thus, the evaporator is defrosted in stages, the defrosting control is precise, the defrosting efficiency is increased, the energy consumption of defrosting is reduced, and the user experience is improved.

BRIEF DESCRIPTION OF THE SEVERAL VIEWS OF THE DRAWINGS

In order to more clearly illustrate the technical solutions in the embodiments of the present disclosure or in the prior art, the following briefly introduces the accompanying drawings that need to be used in the description of the embodiments or the prior art. Obviously, the drawings in the following description are only some embodiments of the present disclosure. For those of ordinary skill in the art, other drawings can also be obtained based on the structures shown in these drawings without any creative effort.

Description of reference signs

Figure 1:
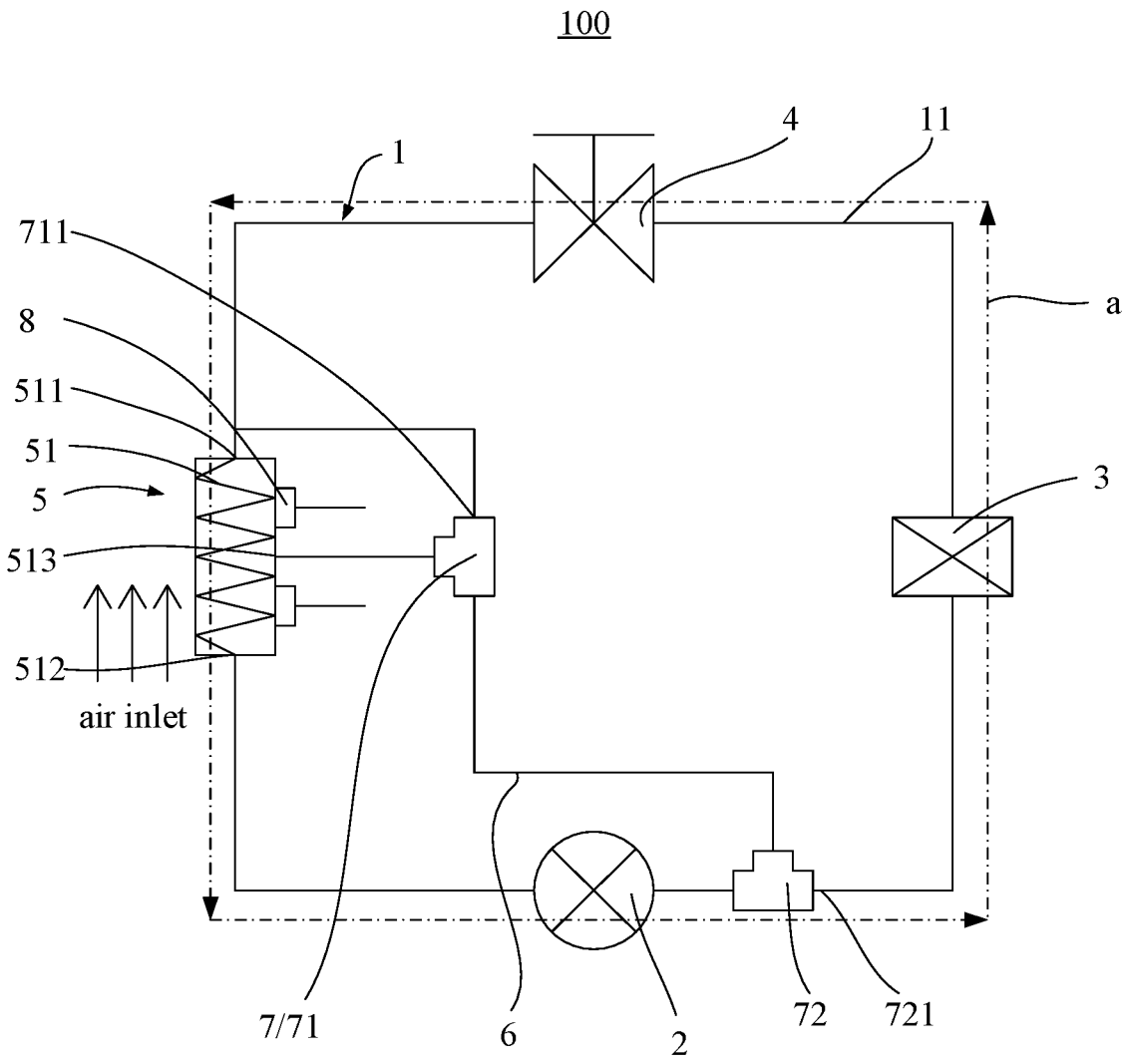
FIG. 1 is a schematic structural diagram of a refrigerator cooling system (in a cooling working mode) according to a first embodiment of the present disclosure.

| Reference sign | Name |
|---|---|
| 100 | refrigerator cooling system |
| 1 | refrigerant circulation flow path |
| 11 | first flow path section |
| 2 | compressor |
| 3 | condenser |
| 4 | throttling device |
| 5 | evaporator |
| 51 | heat exchange core tube |
| 511 | main inlet |
| 512 | main outlet |
| 513 | middle inlet |
| 6 | defrosting branch |
| 7 | switching device |
| 71 | first three-way valve |
| 711 | first communication port |
| 72 | second three-way valve |
| 721 | second communication port |
| 8 | temperature sensor |
| a | flow path in the cooling working mode |
| b | flow path in the defrosting working mode |

The realization of the technical benefits, functional characteristics, and advantages of the present disclosure are further described with reference to the accompanying drawings.

DETAILED DESCRIPTION

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that if there is a directional indication (such as up, down, left, right, front, rear . . . ) in the embodiments of the present disclosure, the directional indication is only used to explain the relative positional relationship, movement, etc., of the components in a certain posture (as shown in the drawings). If the specific posture changes, the directional indication will change accordingly.

Besides, the descriptions associated with, e.g., "first" and "second," in the embodiments of present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. In addition, the technical solutions between the various embodiments can be combined with each other, but they must be based on the realization of those of ordinary skill in the art. When the combination of technical solutions is contradictory or cannot be achieved, it should be considered that such a combination of technical solutions does not exist, nor does it within the scope of the present disclosure.

When the evaporator in the refrigerator is frosted, the thickness of the frost layer is not uniform. The current defrosting technology mainly uses heating devices such as heating tubes to heat the evaporator, which is difficult to accurately defrost, resulting in waste of heat.

In view of this, the present disclosure provides a refrigerator cooling system. FIG. 1 to FIG. 7 are schematic structural diagrams of a refrigerator cooling system according to some embodiments of the present disclosure.

As shown in FIG. 1 to FIG. 4, the refrigerator cooling system 100 includes a refrigerant circulation flow path 1. The refrigerant circulation flow path 1 is provided with a compressor 2, a condenser 3, a throttling device 4 and an evaporator 5. The evaporator 5 includes a heat exchange core tube 51. The heat exchange core tube 51 includes a main inlet 511 communicated with the throttling device 4 and a main outlet 512 communicated with the compressor 2. A middle section of the heat exchange core tube 51 is provided with at least one middle inlet 513. A section of the refrigerant circulation flow path 1 between an exhaust port of the compressor 2 and the main inlet 511 of the evaporator 5 is a first flow path section 11. Both the condenser 3 and the throttling device 4 are located on the first flow path section 11. The refrigerator cooling system 100 further includes a defrosting branch 6 and a switching device 7. The defrosting branch 6 is connected among the exhaust port of the compressor 2, the main inlet 511 and the at least one middle inlet 513. The switching device 7 is for switching the defrosting branch 6 to communicate the exhaust port of the compressor 2 with at least one of the main inlet 511 and the at least one middle inlet 513, to enter a defrosting working mode, and the switching device 7 is further for switching the first flow path section 11 to be in a circulating state, to enter a cooling working mode.

In technical solutions of the present disclosure, the heat exchange core tube 51 of the evaporator 5 includes a main inlet 511 communicated with the throttling device 4 and a main outlet 512 communicated with the compressor 2. A middle section of the heat exchange core tube 51 is provided with at least one middle inlet 513. A section of the refrigerant circulation flow path 1 between an exhaust port of the compressor 2 and the main inlet 511 of the evaporator 5 is a first flow path section 11. The defrosting branch 6 is connected among the exhaust port of the compressor 2, the main inlet 511 and the at least one middle inlet 513. When the refrigerator cooling system 100 is normally cooling, the switching device 7 switches the first flow path section 11 to be in a circulating state. When the refrigerator cooling system 100 is defrosting, the switching device 7 switches the defrosting branch 6 to communicate the exhaust port of the compressor 2 with at least one of the main inlet 511 and the at least one middle inlet 513. When the exhaust port of the compressor 2 is communicated with the main inlet 511, the entire heat exchange core tube 51 is defrosted. When the exhaust port of the compressor 2 is communicated with the at least one middle inlet 513, the heat exchange core tube 51 is defrosted in part. Thus, the evaporator 5 is defrosted in stages, the defrosting control is precise, the defrosting efficiency is increased, the energy consumption of defrosting is reduced, and the user experience is improved.

It should be noted that the defrosting branch 6 makes the refrigerant not pass through the throttling device 4, and the refrigerant has a higher temperature. When the refrigerant with a higher temperature directly enters the evaporator 5, the defrosting of the heat exchange core tube 51 is realized, and the evaporator 5 is defrosted in stages. The defrosting branch 6 can be a plurality of parallel branches. One end of the plurality of branches is used to communicate with the exhaust port of the compressor 2, and the other end is communicated with the main inlet 511 and the at least one middle inlet 513, respectively. The switching device 7 only needs to switch one of the branches to conduct, and of course, a plurality of the branches can be conducted at the same time.

In an embodiment, the defrosting branch 6 is a single branch, one end is communicated with the exhaust port of the compressor 2, and the other end can be switched to select different inlets on the heat exchange core tube 51. The defrosting branch 6 has one input port and a plurality of output ports. The input port is connected between the exhaust port of the compressor 2 and the condenser 3. The plurality of output ports are respectively provided corresponding to the main inlet 511 and at least one middle inlet 513. The switching device 7 includes a first switching device and a second switching device. The first switching device is for switching at least one of the plurality of output ports to communicate with one of the main inlet 511 and the at least one middle inlet 513. The second switching device is for switching one of the input port and the first flow path section 11 to communicate with the exhaust port of the compressor 2. Through the cooperation of the first switching device and the second switching device, the switching between the defrosting working mode and the cooling working mode of the refrigerator cooling system 100 is easily realized, and the evaporator 5 is also easily defrosted in stages, which has a good effect.

Both the first switching device and the second switching device can be configured as a valve combination structure, such as two one-way valves arranged in parallel, etc. In an embodiment, the first switching device includes a first three-way valve 71, the first three-way valve 71 is formed with three first communication ports 711 that communicate with each other, two of the three first communication ports 711 are connected in series between the defrosting branch 6 and the main inlet 511, and the other first communication port 711 is connected to one of the middle inlets 513. The first three-way valve 71 realizes switching at least one of the output ports to communicate with the corresponding one of the main inlet 511 and the at least one middle inlet 513, the structure is simple, and the switching is convenient.

When there are a plurality of middle inlets 513, as shown in FIG. 4 to FIG. 7, the first switching device includes a plurality of first three-way valves 71, two first communication ports 711 of each of the plurality of first three-way valves 71 are connected in series between the defrosting branch 6 and the main inlet 511, and the other communication ports of the plurality of first three-way valves 71 are correspondingly connected to the plurality of middle inlets 513. Each of the first three-way valves 71 switches one of the plurality of output ports to communicate with the corresponding middle inlet 513, which has a simple structure and is convenient for switching.

In an embodiment, the first three-way valve 71 is an electromagnetic three-way valve, which facilitates automatic control of the first three-way valve 71, has a high degree of automation, and improves user experience.

In an embodiment, the second switching device includes a second three-way valve 72, and the second three-way valve 72 is formed with three second communication ports 721 that communicate with each other. A first one of the three second communication ports 721 is communicated with the first flow path section 11, a second one of the three second communication ports 721 is communicated with the exhaust port of the compressor 2, and a third one of the three second communication ports 721 is communicated with the defrosting branch 6. The second three-way valve 72 realizes switching one of the input port and the first flow path section 11 to communicate with the exhaust port of the compressor 2, which has a simple structure and is convenient for switching.

In an embodiment, the second three-way valve 72 is an electromagnetic three-way valve, which facilitates automatic control of the second three-way valve 72, has a high degree of automation, and improves user experience.

It should be noted that the switching between the cooling working mode and the defrosting working mode of the refrigerator cooling system 100 may take the time parameter as the reference object. For example, after the refrigerator cooling system operates in the cooling working mode for a period of time, the refrigerator cooling system switches from the cooling working mode to the defrosting working mode. The refrigerator cooling system also switches from the defrosting working mode to the cooling working mode after the refrigerator cooling system operates in the defrosting working mode for a period of time. The switching can also take the temperature parameter as the reference object. For example, when the surface temperature of the evaporator 5 is lower than the first preset temperature after the refrigerator cooling system operates in the cooling working mode for a period of time, the refrigerator cooling system 100 switches from the cooling working mode to the defrosting working mode. It can also be that after the refrigerator cooling system 100 operates in the defrosting working mode for a period of time, the surface temperature of the evaporator 5 is higher than the second preset temperature, the refrigerator cooling system 100 switches from the defrosting working mode to the cooling working mode.

When the switching takes the temperature parameter as the reference object, after the refrigerator cooling system 100 operates in the defrosting working mode for a period of time, the surface temperature of the evaporator 5 is higher than the second preset temperature, the refrigerator cooling system 100 switches from the defrosting working mode to the cooling working mode. In an embodiment, the switching device 7 is an electrical switching device. The refrigerator cooling system further includes a temperature sensor 8 and a control assembly. The temperature sensor 8 is for detecting a surface temperature of the evaporator 5. The control assembly is electrically connected to the temperature sensor 8 and the electrical switching device, for switching a working mode of the refrigerator cooling system 100 according to a temperature obtained by the temperature sensor 8. This arrangement enables the refrigerator cooling system 100 to switch between the cooling working mode and the defrosting working mode more intelligently.

In an embodiment, the at least one middle inlet 513 is configured to divide the heat exchange core tube 51 into a plurality of heat exchange sections, and a plurality of the temperature sensors 8 are provided corresponding to the plurality of the heat exchange sections. The plurality of the temperature sensors 8 can detect the temperature on the entire length of the heat exchange core tube 51, and the obtained temperature is relatively accurate, which is convenient for controlling the refrigerator cooling system 100 to achieve accurate defrosting.

In the following, in two embodiments, the corresponding flow direction of the refrigerant in the refrigerant circulation flow path 1 and the action of the three-way valve illustrate the principle of the refrigerator cooling system 100 switching between the cooling working mode and the defrosting working mode.

Figure 2:
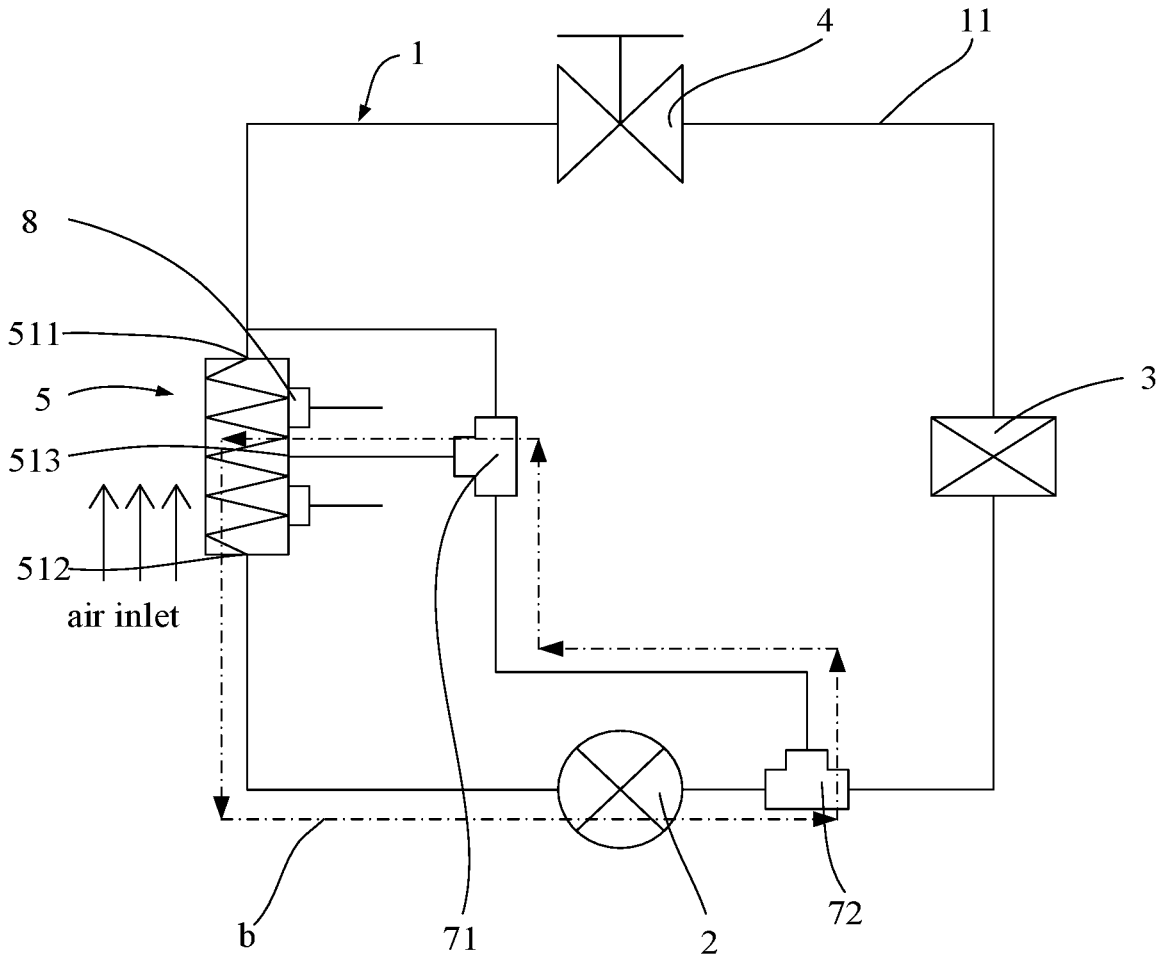
FIG. 2 is a schematic diagram of a refrigerant flow path of the refrigerator cooling system in FIG. 1 in a partial defrosting mode.
Figure 3:
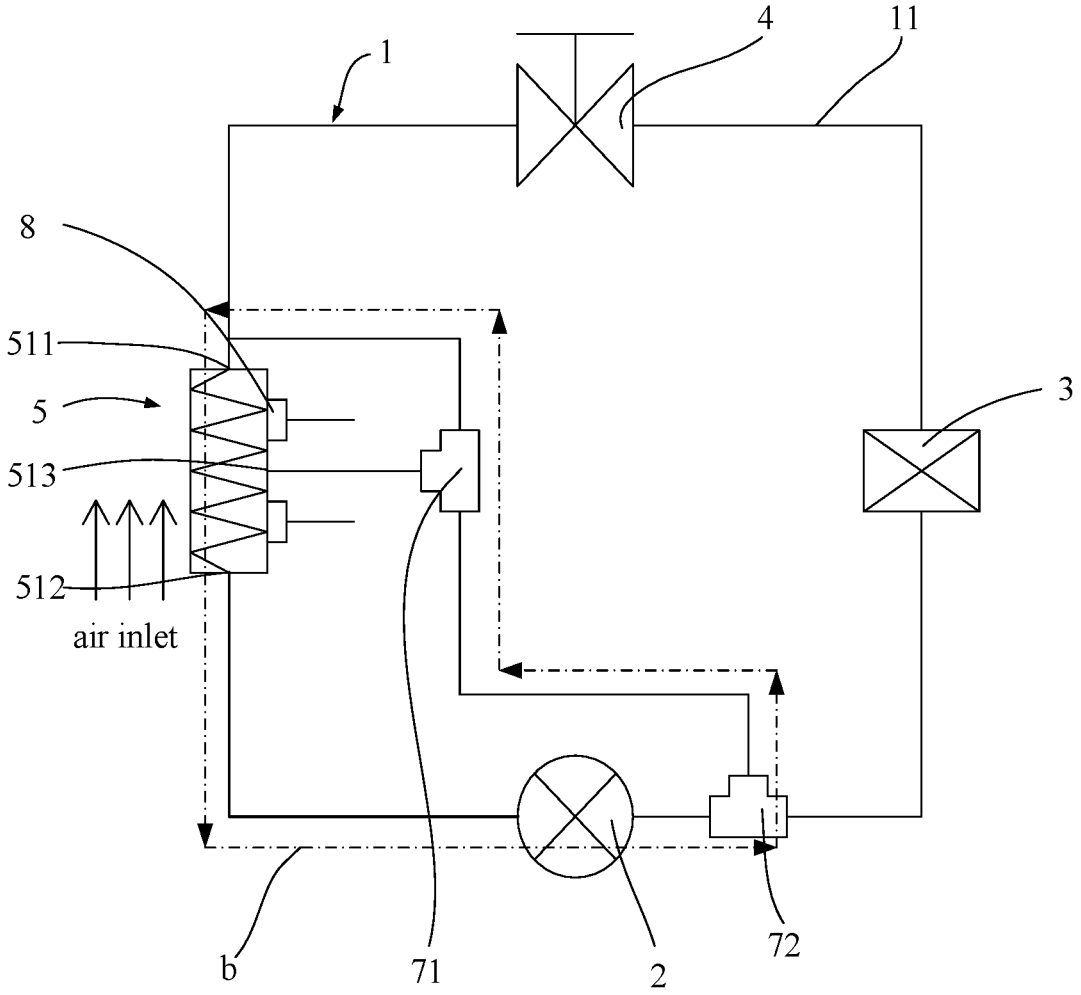
FIG. 3 is a schematic diagram of a refrigerant flow path of the refrigerator cooling system in FIG. 1 in a full defrosting mode.
Figure 4:
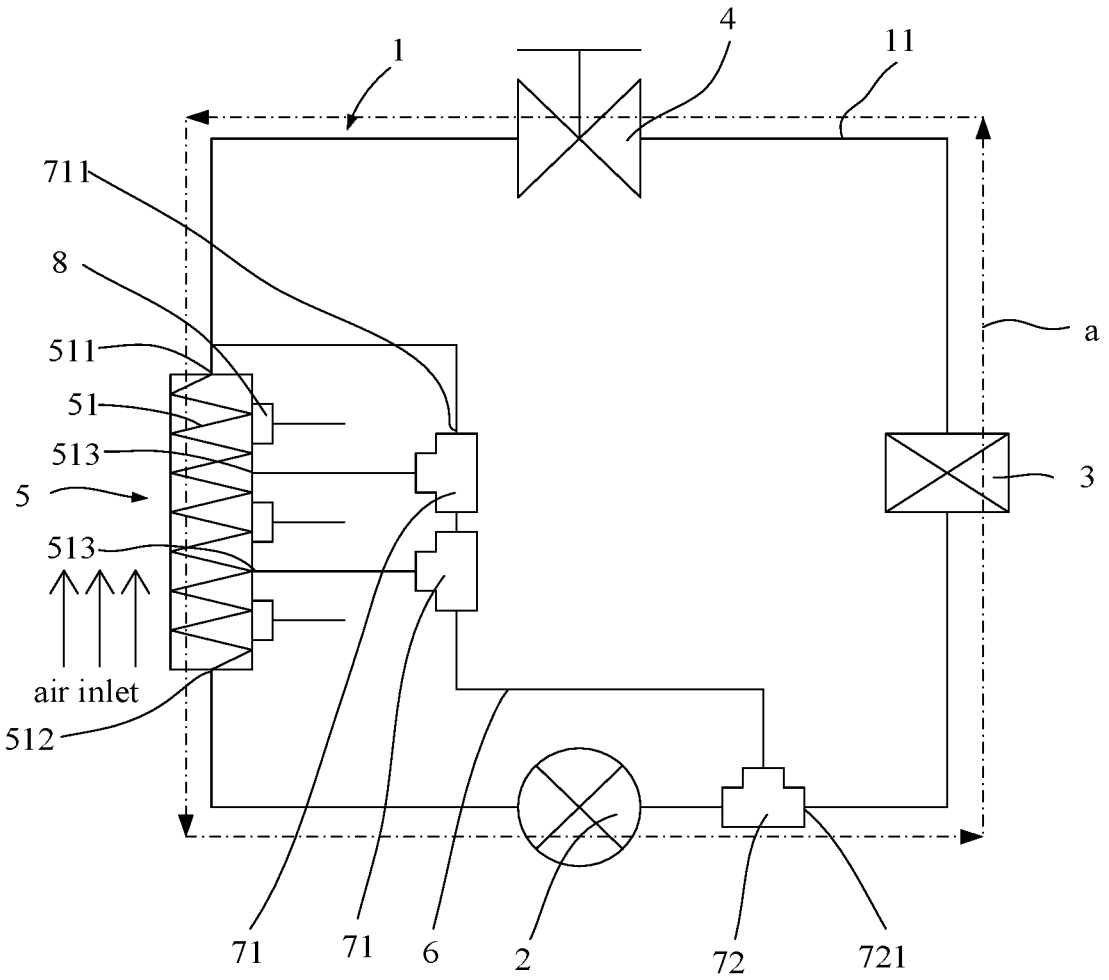
FIG. 4 is a schematic structural diagram of a refrigerator cooling system (in a cooling working mode) according to a second embodiment of the present disclosure.
Figure 5:
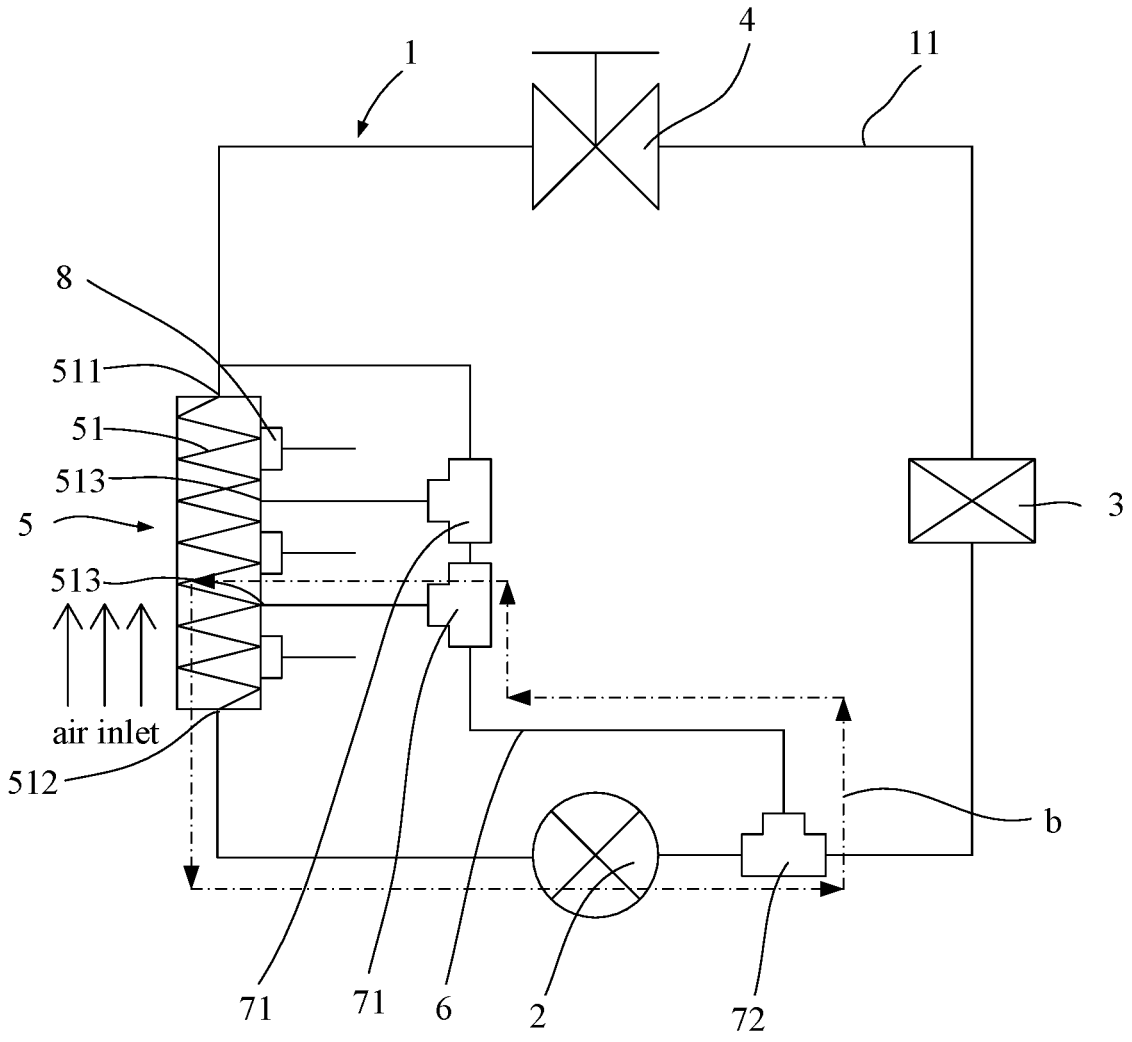
FIG. 5 is a schematic diagram of a refrigerant flow path of the refrigerator cooling system in FIG. 4 in a first partial defrosting mode.
Figure 6:
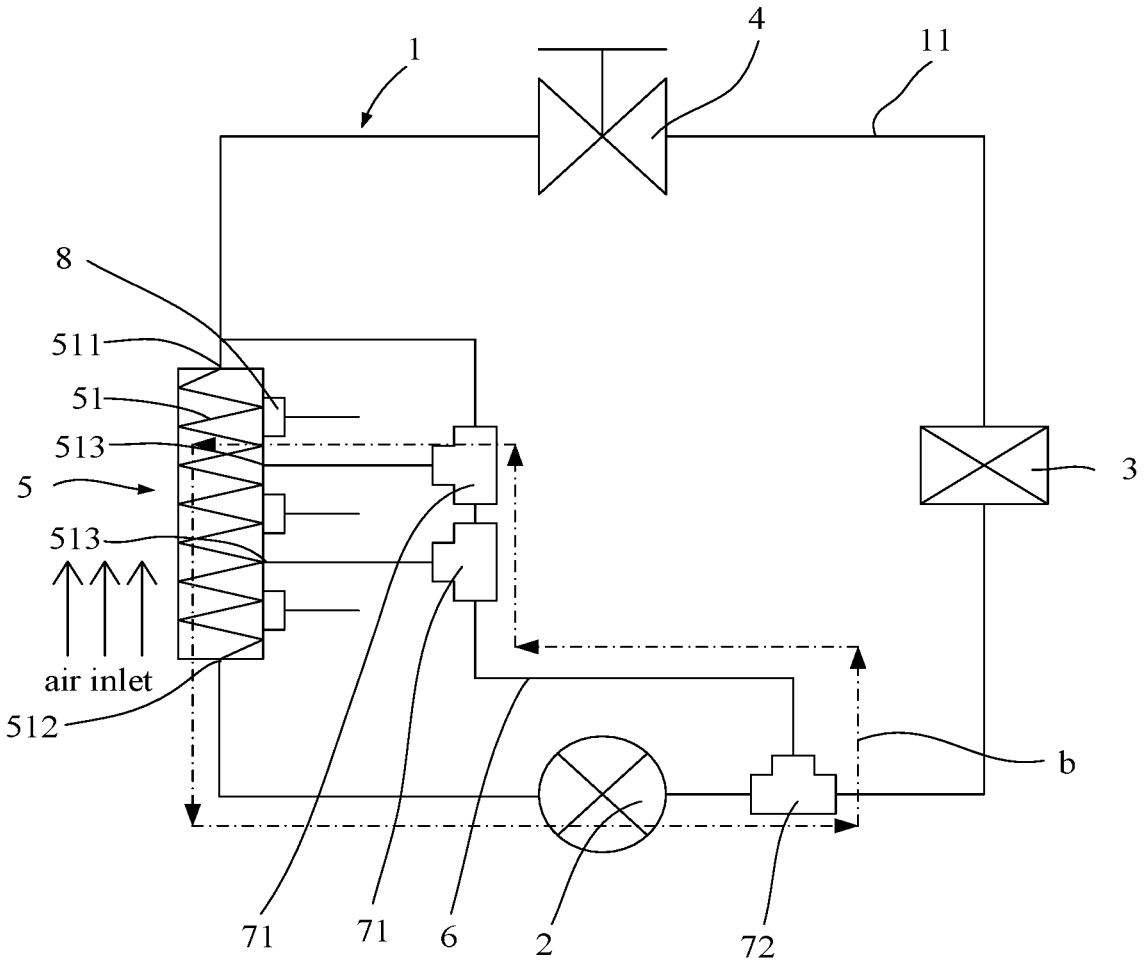
FIG. 6 is a schematic diagram of a refrigerant flow path of the refrigerator cooling system in FIG. 4 in a second partial defrosting mode.
Figure 7:
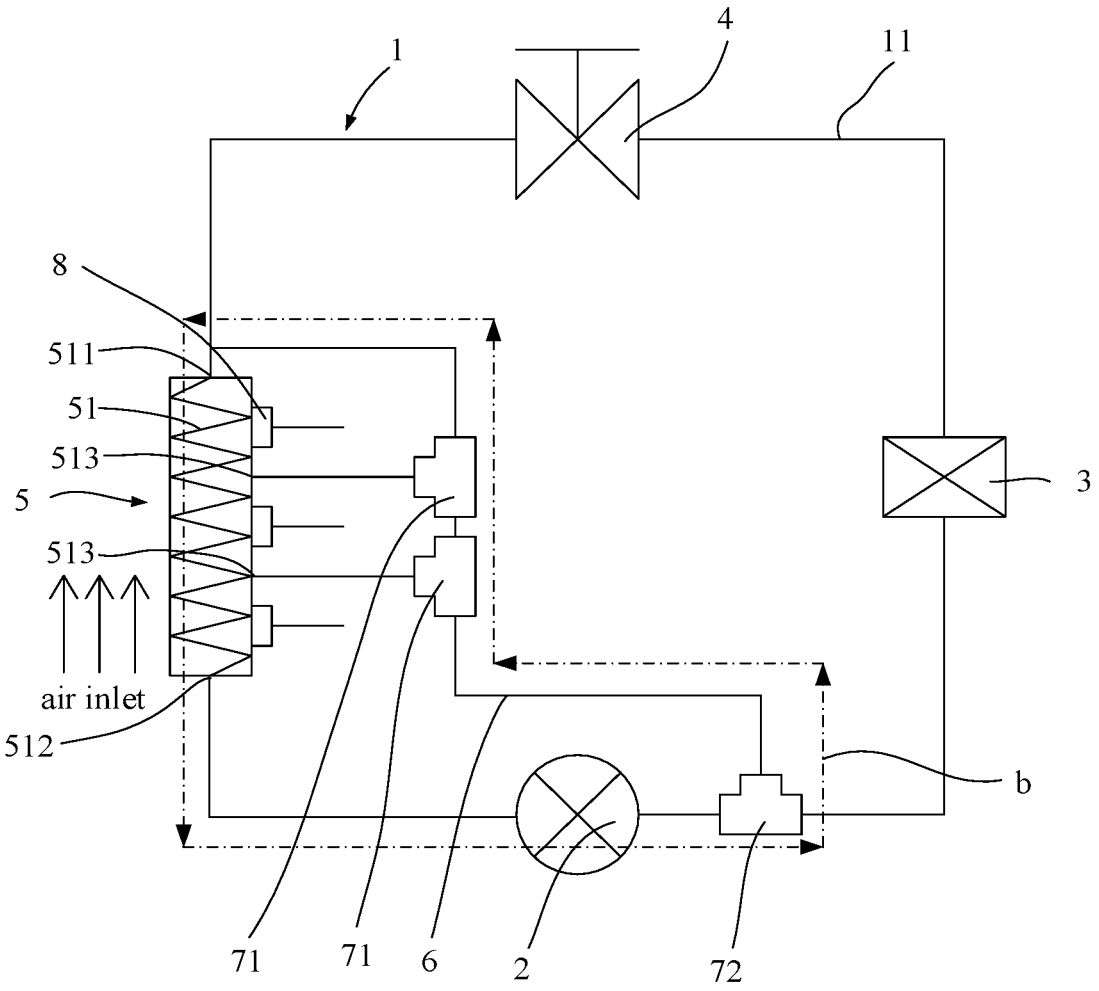
FIG. 7 is a schematic diagram of a refrigerant flow path of the refrigerator cooling system in FIG. 4 in a full defrosting mode.

1. As shown in FIG. 1, a flow path a in the cooling working mode is provided. In FIG. 1, the refrigerator cooling system 100 is in the cooling working mode. The refrigerant in the compressor 2 passes through the condenser 3 to form a liquid refrigerant with high temperature and high pressure. After the liquid refrigerant passes through the throttling device 4, a liquid refrigerant with low temperature and low pressure is formed, and after the refrigerant passes through the evaporator 5, a gaseous refrigerant with low temperature and low pressure is formed, and then flows back into the compressor 2.
2. As shown in FIG. 2, a flow path b in the defrosting working mode is provided. In FIG. 2, the refrigerator cooling system 100 is in the defrosting working mode. The refrigerant in the compressor 2 enters the middle inlet 513 of the heat exchange core tube 51 after passing through the second three-way valve 72 and the first three-way valve 71. The liquid refrigerant with high temperature and high pressure in the compressor 2 flows back into the compressor 2 after passing through the heat exchange core tube 51 in part.
3. As shown in FIG. 3, a flow path b in the defrosting working mode is provided. In FIG. 3, the refrigerator cooling system 100 is in the defrosting working mode. The refrigerant in the compressor 2 enters the main inlet 511 of the heat exchange core tube 51 after passing through the second three-way valve 72 and the first three-way valve 71. The high-temperature and high-pressure liquid refrigerant in the compressor 2 flows back into the compressor 2 after passing through the heat exchange core tube 51 as a whole.
4. As shown in FIG. 4, a flow path a in the cooling working mode is provided. In FIG. 4, the refrigerator cooling system 100 is in the cooling working mode. The refrigerant in the compressor 2 passes through the condenser 3 to form a liquid refrigerant with high temperature and high pressure. After the liquid refrigerant passes through the throttling device 4, a liquid refrigerant with low temperature and low pressure is formed, and after the refrigerant passes through the evaporator 5, a gaseous refrigerant with low temperature and low pressure is formed, and then flows back into the compressor 2.
5. As shown in FIG. 5, a flow path b in the defrosting working mode is provided. In FIG. 5, the refrigerator cooling system 100 is in the defrosting working mode. The refrigerant in the compressor 2 enters the first middle inlet of the heat exchange core tube 51 after passing through the second three-way valve 72 and the first three-way valve 71. The liquid refrigerant with high temperature and high pressure in the compressor 2 flows back into the compressor 2 after passing through the heat exchange core tube 51 in part.
6. As shown in FIG. 6, a flow path b in the defrosting working mode is provided. In FIG. 6, the refrigerator cooling system 100 is in the defrosting working mode. The refrigerant in the compressor 2 enters the second middle inlet of the heat exchange core tube 51 after passing through the second three-way valve 72 and the first three-way valve 71. The liquid refrigerant with high temperature and high pressure in the compressor 2 flows back into the compressor 2 after passing through the heat exchange core tube 51 in part.
7. As shown in FIG. 7, a flow path b in the defrosting working mode is provided. In FIG. 7, the refrigerator cooling system 100 is in the defrosting working mode. The refrigerant in the compressor 2 enters the main inlet 511 of the heat exchange core tube 51 after passing through the second three-way valve 72 and the first three-way valve 71. The liquid refrigerant with high temperature and high pressure in the compressor 2 flows back into the compressor 2 after passing through the heat exchange core tube 51 as a whole.

The present disclosure further provides a method for defrosting a refrigerator. FIG. 8 to FIG. 11 are schematic diagrams of a method for defrosting a refrigerator according to some embodiments of the present disclosure.

Figure 8:
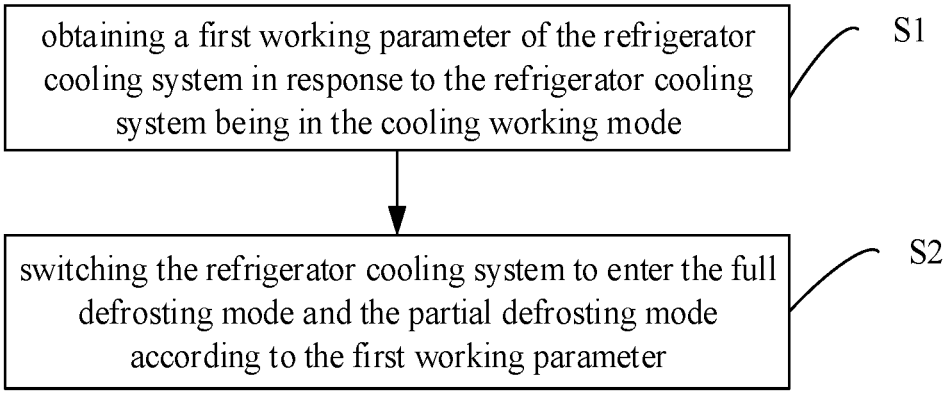
FIG. 8 is a schematic flowchart of a method for defrosting a refrigerator according to a first embodiment of the present disclosure.

As shown in FIG. 8, FIG. 8 is a schematic flowchart of a method for defrosting a refrigerator according to a first embodiment of the present disclosure.

The defrosting working mode includes a full defrosting mode and at least one partial defrosting mode. When the refrigerator cooling system is in the full defrosting mode, the defrosting branch 6 is communicated with the exhaust port of the compressor 2 and is provided corresponding to the main inlet 511. When the refrigerator cooling system is in the partial defrosting mode, the defrosting branch 6 is communicated with the exhaust port of the compressor 2 and is provided corresponding to the middle inlet 513.

The method for defrosting the refrigerator includes following operations:

S1, obtaining a first working parameter of the refrigerator cooling system in response to the refrigerator cooling system 100 being in the cooling working mode.

It should be noted that the cooling system of the refrigerator needs to provide cooling capacity for the refrigerating chamber and the freezing chamber. After a long time of operation, the refrigerator will form frost, and the thickness of the frost on core tubes of the evaporator 5 is not uniform.

S2, switching the refrigerator cooling system to enter the full defrosting mode and the partial defrosting mode according to the first working parameter.

It should be noted that the first working parameter includes a temperature parameter and a working duration parameter. When the time parameter is used as the reference object, for example, after the refrigerator cooling system operates in the cooling working mode for a period of time, the refrigerator cooling system switches from the cooling working mode to the defrosting working mode. The refrigerator cooling system can switch from the defrosting mode to the cooling working mode after operating in the defrosting working mode for a period of time. The temperature parameter may also be the reference object. For example, when the temperature of the evaporator 5 is lower than the preset temperature value, the cooling working mode is switched to the defrosting working mode. When the temperature of the evaporator 5 is greater than a preset temperature value, the defrosting working mode is switched to the cooling working mode.

In an embodiment, when the time parameter is used as the reference object, after the refrigerator works for a long time, the refrigerator will be frosted, and it needs to be defrosted at this time. It is possible to set a preset duration to start the defrosting mode of the refrigerator, such as 6 h, 8 h, 10 h, 12 h, or the like. It can also be considered according to the actual working environment of the refrigerator, such as humidity environment. Different humidity environments corresponding to different preset durations. When the actual duration reaches the preset duration, the defrosting working mode can be automatically started to perform the defrosting operation on the refrigerator. In addition, if the duration parameter reaches 6 hours, the refrigerator cooling system 100 is switched to enter the partial defrosting mode, and when the duration parameter reaches 8 hours, the refrigerator cooling system 100 is switched to enter the full defrosting mode.

In technical solutions of the present disclosure, when the refrigerator cooling system 100 is in the cooling working mode, the first working parameter of the refrigerator cooling system 100 is obtained. The refrigerator cooling system 100 is switched to enter the full defrosting mode and the partial defrosting mode according to the first working parameter. Thus, the evaporator 5 is defrosted in stages, the defrosting control is precise, the defrosting efficiency is increased, the energy consumption of defrosting is reduced, and the user experience is improved.

Figure 9:
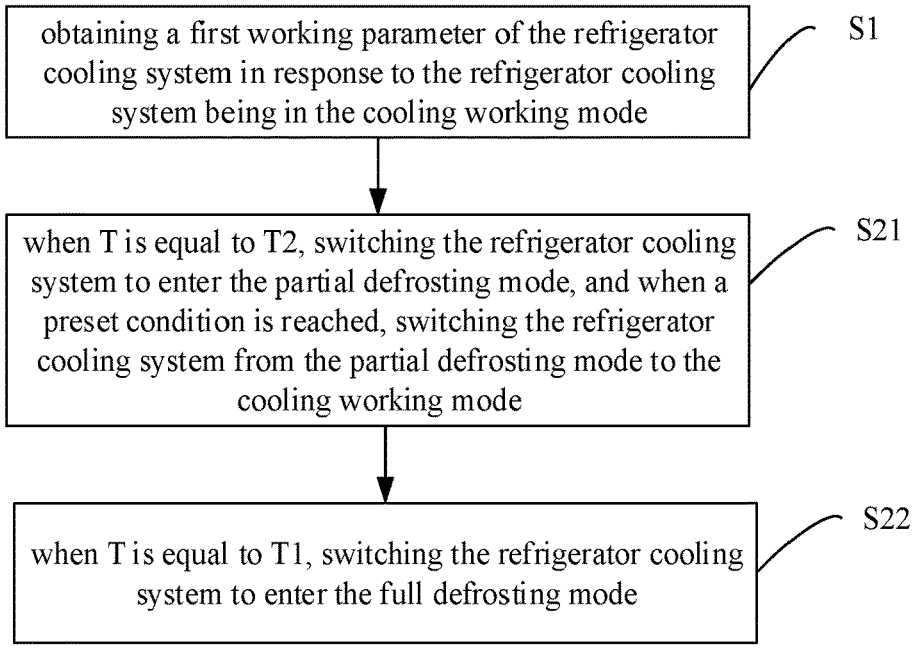
FIG. 9 is a schematic flowchart of a method for defrosting a refrigerator according to a second embodiment of the present disclosure.

As shown in FIG. 9, FIG. 9 is a schematic flowchart of a method for defrosting a refrigerator according to a second embodiment of the present disclosure.

The first working parameter is an actual working duration parameter T.

In this embodiment, with respect to the first embodiment of the method for defrosting a refrigerator, the method further includes the following operations:

S21, when T is equal to T2, switching the refrigerator cooling system to enter the partial defrosting mode, and when a preset condition is reached, switching the refrigerator cooling system from the partial defrosting mode to the cooling working mode, T2 is a preset cooling duration for partial defrosting; and S22, when T is equal to T1, switching the refrigerator cooling system to enter the full defrosting mode, T1 is a preset cooling duration period for full defrosting, and T1 is greater than T2.

It should be noted that the T2 is a specific value smaller than T1, for example, when T1 is 10 h, T2 may be 6 h or 8 h, and so on.

In addition, the preset condition may be satisfying a time condition, or satisfying a temperature condition, and so on.

When the refrigerator cooling system 100 works for a short period of time, the heat exchange core tube 51 of the evaporator 5 is partially frosted, and it is only necessary to defrost the part that is prone to frost. When the refrigerator cooling system 100 works for a long time, the heat exchange core tube 51 of the evaporator 5 will be frosted as a whole, and the entire heat exchange core tube 51 needs to be defrosted. Thus, the evaporator 5 is defrosted in stages, the defrosting control is precise, the defrosting efficiency is increased, the energy consumption of defrosting is reduced, and the user experience is improved.

Figure 10:
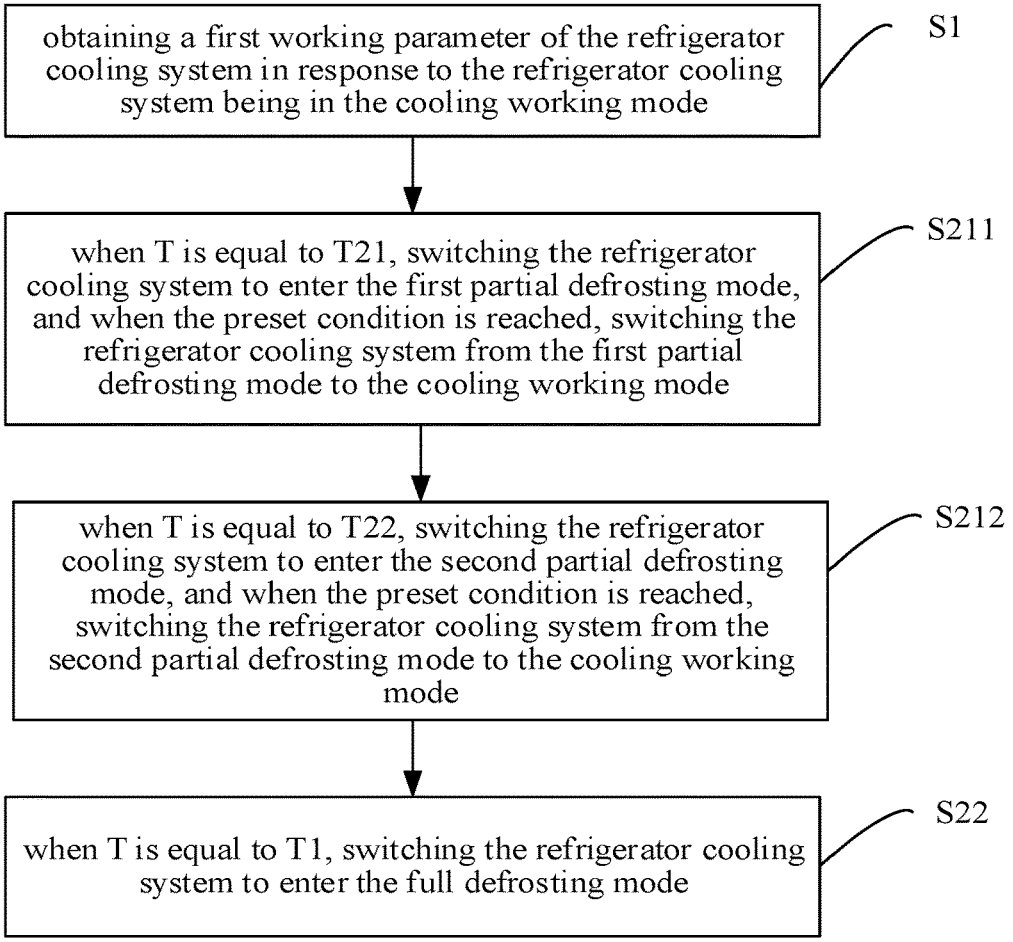
FIG. 10 is a schematic flowchart of a method for defrosting a refrigerator according to a third embodiment of the present disclosure.

As shown in FIG. 10, FIG. 10 is a schematic flowchart of a method for defrosting a refrigerator according to a third embodiment of the present disclosure.

A plurality of middle inlets 513 are provided, the plurality of middle inlets 513 include a first middle inlet away from the main inlet 511 and a second middle inlet adjacent to the main inlet 511. The partial defrosting mode includes a first partial defrosting mode and a second partial defrosting mode. When the refrigerator cooling system is in the first partial defrosting mode, the defrosting branch 6 is communicated with the exhaust port of the compressor 2 and the first middle inlet. When the refrigerator cooling system is in the second partial defrosting mode, the defrosting branch 6 is communicated with the exhaust port of the compressor 2 and the second middle inlet.

In this embodiment, with respect to the second embodiment of the method for defrosting a refrigerator, the method further includes the following operations:

S211, when T is equal to T21, switching the refrigerator cooling system to enter the first partial defrosting mode, and when the preset condition is reached, switching the refrigerator cooling system from the first partial defrosting mode to the cooling working mode, wherein T21 is a preset cooling duration for a first partial defrosting, and T21 is less than T1.

It should be noted that the preset condition may be satisfying a time condition, or satisfying a temperature condition, and so on.

S212, when T is equal to T22, switching the refrigerator cooling system to enter the second partial defrosting mode, and when the preset condition is reached, switching the refrigerator cooling system from the second partial defrosting mode to the cooling working mode, wherein T22 is a preset cooling duration for a second partial defrosting, and T22 is less than T1 and greater than T21.

It should be noted that the preset condition may be satisfying a time condition, or satisfying a temperature condition, and so on.

The heat exchange core tube 51 is divided more accurately, and the defrosting is more accurately segmented. After a period of time, it is possible to defrost the parts that are more prone to frost. After a long period of time, the heat exchange core tube 51 is defrosted as a whole, the defrosting control is precise, the defrosting efficiency is increased, the energy consumption of defrosting is reduced, and the user experience is improved.

Figure 11:
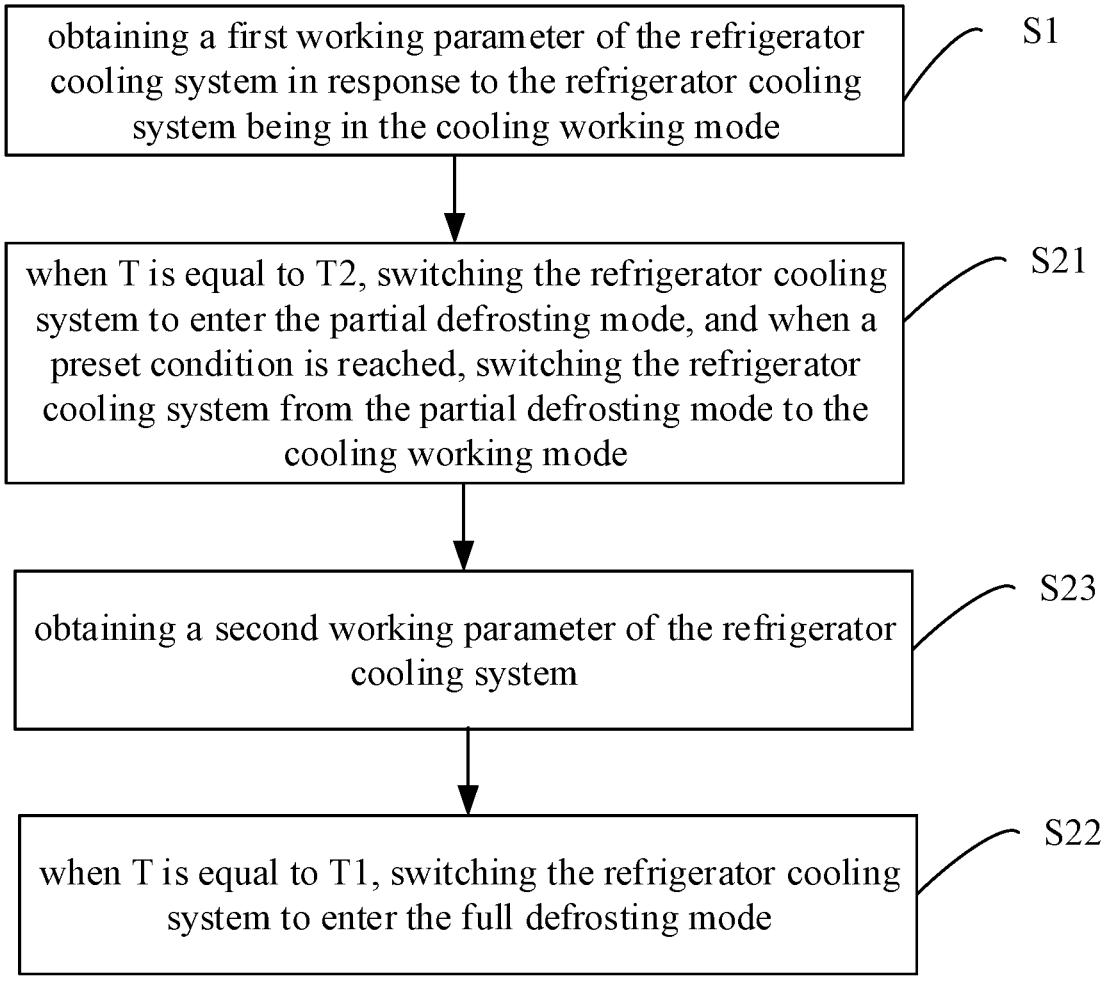
FIG. 11 is a schematic flowchart of a method for defrosting a refrigerator according to a fourth embodiment of the present disclosure.

As shown in FIG. 11, FIG. 11 is a schematic flowchart of a method for defrosting a refrigerator according to a fourth embodiment of the present disclosure.

In this embodiment, with respect to the second embodiment of the method for defrosting a refrigerator, the method further includes the following operations:

S23, obtaining a second working parameter of the refrigerator cooling system.

It should be noted that the second working parameter includes a temperature parameter and a working duration parameter. When the refrigerator cooling system 100 switches from the full defrost working mode to the cooling working mode, or switches from the partial defrosting working mode to the cooling working mode, the second working parameter of the refrigerator cooling system 100 needs to be obtained, and when the second working parameter reaches the parameter preset value, the mode is switched.

In an embodiment, the second working parameter is the actual temperature parameter t of the evaporator 5, and the preset condition is that t is equal to t1, t1 is the temperature preset value. It should be noted that, in the entire cooling system of the refrigerator, the evaporator 5 provides cold energy to the refrigerator chamber and the freezing chamber of the refrigerator. During the long-term operation of the evaporator 5, frost will form on the part of the evaporator 5 correspondingly. The degree of frost formation in the refrigerator can be known by detecting the surface temperature of the evaporator 5 of the refrigerator, which is usually the surface temperature of the evaporator 5 obtained by the temperature sensor 8.

Besides, it should be noted that when the middle inlet 513 divides the heat exchange core tube 51 into a plurality of heat exchange sections, each length of the heat exchange section is provided with a temperature sensor 8. When performing mode switching, the temperature conditions of multiple temperature sensors 8 can be considered at the same time. For example, when the refrigerator cooling system 100 is in the full defrosting mode, it can be considered that when the temperature of the temperature sensor 8 on each of the heat exchange sections reaches the preset temperature, it switches to the cooling working mode. When the refrigerator cooling system 100 is in the partial defrosting mode, it may be considered that when the temperature of the temperature sensor 8 on the heat exchange section for the local circulating refrigerant reaches the preset temperature, it switches to the cooling working mode.

The above are only some embodiments of the present disclosure, and do not limit the scope of the present disclosure thereto. Under the concept of the present disclosure, equivalent structural transformations made according to the description and drawings of the present disclosure, or direct/indirect application in other related technical fields are included in the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A refrigerator cooling system, comprising:

a refrigerant circulation flow path including a compressor, a condenser and an evaporator;

a defrosting branch; and a three-way valve, wherein:

the evaporator comprises a heat exchange core tube, the heat exchange core tube comprises a main inlet and a main outlet in communication with the compressor, a middle section of the heat exchange core tube is provided with at least one middle inlet, wherein the heat exchange core tube is divided into at least two heat exchange sections including a first heat exchange section between the main inlet and the at least one middle inlet and a second heat exchange section between the main outlet and the at least one middle inlet, at least two temperature sensors each positioned on a corresponding heat exchange section of the at least two heat exchange sections of the heat exchange core, respectively, and configured to detect a temperature of the corresponding heat exchange section, a first flow path section of the refrigerant circulation flow path is positioned between an exhaust port of the compressor and the main inlet of the evaporator, the condenser is located on the first flow path section, the defrosting branch is connected among the exhaust port of the compressor, the main inlet, and the at least one middle inlet, the three-way valve is configured to switch the defrosting branch to communicate the exhaust port of the compressor with the main inlet or the at least one middle inlet, to enter a defrosting working mode based on a temperature detected by the at least two temperature sensors, the defrosting branch is configured to defrost the heat exchange core tube when the exhaust port of the compressor communicates with the main inlet, and the defrosting branch is configured to defrost the second heat exchange section when the exhaust port of the compressor communicates with the at least one middle inlet; and the three-way valve is further configured to switch the first flow path section to be in a circulating state, to enter a cooling working mode;

the defrosting working mode comprises a full defrosting mode and a partial defrosting mode;

wherein the refrigerator cooling system is configured to:

obtain a first working parameter in response to the refrigerator cooling system being in the cooling working mode; and switch the refrigerator cooling system to enter the full defrosting mode or the partial defrosting mode according to the first working parameter:

wherein the first working parameter comprises a temperature of a heat exchange section of the at least two heat exchange sections and a working duration T of the refrigerator.

2. The refrigerator cooling system of claim 1, wherein:

the defrosting branch has one input port and a plurality of output ports, the input port is connected between the exhaust port of the compressor and the condenser, the plurality of output ports are respectively provided corresponding to the main inlet and at least one middle inlet, the three-way valve comprises a first three-way valve and a second three-way valve, the first three-way valve is configured to switch at least one of the plurality of output ports to communicate with one inlet among the main inlet and the at least one middle inlet, and the second three-way valve is configured to switch one of the input port or the first flow path section to communicate with the exhaust port of the compressor.

3. The refrigerator cooling system of claim 2, wherein the first three-way valve comprises a first three-way valve, the first three-way valve includes three first communication ports in communication with one another, two of the three first communication ports are connected in series between the defrosting branch and the main inlet, and a third one of first communication port is connected to one of the middle inlets.

4. The refrigerator cooling system of claim 3, wherein:

the middle section of the heat exchange core tube comprises a plurality of middle inlets, the first three-way valve comprises a plurality of first three-way valves, two first communication ports of each of the plurality of first three-way valves are connected in series between the defrosting branch and the main inlet, and other communication ports of the plurality of first three-way valves are correspondingly connected to the plurality of middle inlets.

5. The refrigerator cooling system of claim 3, wherein the first three-way valve is an electromagnetic three-way valve.

6. The refrigerator cooling system of claim 2, wherein:

the second three-way valve comprises a three-way valve, the three-way valve includes three communication ports in communication with one another, and a first one of the three communication ports is in communication with the first flow path section, a second one of the three communication ports is in communication with the exhaust port of the compressor, and a third one of the three communication ports is in communication with the defrosting branch.

7. The refrigerator cooling system of claim 6, wherein the second three-way valve is an electromagnetic three-way valve.

8. The refrigerator cooling system of claim 1, wherein the three-way valve is an electrical three-way valve, and the refrigerator cooling system further comprises:

a control assembly electrically connected to the at least two temperature sensors and the electrical three-way valve, the control assembly configured to switch a working mode of the refrigerator cooling system based on a temperature detected by a temperature sensor of the at least two temperature sensors.

9. A method for defrosting a refrigerator having a refrigerator cooling system, wherein the refrigerator cooling system includes a refrigerant circulation flow path and a defrosting branch, the refrigerant circulation flow path includes a compressor, a condenser and an evaporator having a heat exchange core tube, the heat exchange core tube including a main inlet, a main outlet, and at least one middle inlet positioned between the main inlet and the main outlet, wherein the heat exchange core tube is divided into at least two heat exchange sections including a first heat exchange section between the main inlet and the at least one middle inlet and a second heat exchange section between the main outlet and the at least one middle inlet, at least two temperature sensors each positioned on a corresponding heat exchange section of the at least two heat exchange sections of the heat exchange core, respectively, and configured to detect a temperature of the corresponding heat exchange section, and the refrigerator cooling system includes a cooling working mode and a defrosting working mode that comprises a full defrosting mode and a partial defrosting mode, in response to the refrigerator cooling system being in the full defrosting mode, the defrosting branch is communicated with an exhaust port of the compressor and a main inlet of the evaporator, and in response to the refrigerator cooling system being in the partial defrosting mode, the defrosting branch is communicated with the exhaust port of the compressor and a middle inlet of the evaporator, the method comprising:

obtaining a first working parameter in response to the refrigerator cooling system being in the cooling working mode; and switching the refrigerator cooling system to enter the full defrosting mode or the partial defrosting mode according to the first working parameter;

wherein the first working parameter comprises a temperature of a heat exchange section of the at least two heat exchange sections and a working duration T of the refrigerator.

10. The method for defrosting the refrigerator of claim 9, wherein the switching the refrigerator cooling system to enter the full defrosting mode and the partial defrosting mode according to the first working parameter comprises:

when T is equal to T2, switching the refrigerator cooling system to enter the partial defrosting mode, and when a preset condition is reached, switching the refrigerator cooling system from the partial defrosting mode to the cooling working mode, wherein T2 is a preset cooling duration for partial defrosting; and when T is equal to T1, switching the refrigerator cooling system to enter the full defrosting mode, wherein T1 is a preset cooling duration for full defrosting, and T1 is greater than T2.

11. The method for defrosting the refrigerator of claim 10, wherein the evaporator includes a plurality of middle inlets, the plurality of middle inlets comprise a first middle inlet away from the main inlet and a second middle inlet adjacent to the main inlet, the partial defrosting mode comprises a first partial defrosting mode and a second partial defrosting mode, in response to the refrigerator cooling system being in the first partial defrosting mode, the defrosting branch is communicated with the exhaust port of the compressor and the first middle inlet, in response to the refrigerator cooling system being in the second partial defrosting mode, the defrosting branch is communicated with the exhaust port of the compressor and the second middle inlet, and the switching the refrigerator cooling system to enter the partial defrosting mode, and the switching the refrigerator cooling system from the partial defrosting mode to the cooling working mode comprises:

when T is equal to T21, switching the refrigerator cooling system to enter the first partial defrosting mode, and when the preset condition is reached, switching the refrigerator cooling system from the first partial defrosting mode to the cooling working mode, wherein T21 is a preset cooling duration for a first partial defrosting, and T21 is less than T1; and when T is equal to T22, switching the refrigerator cooling system to enter the second partial defrosting mode, and when the preset condition is reached, switching the refrigerator cooling system from the second partial defrosting mode to the cooling working mode, wherein T22 is a preset cooling duration for a second partial defrosting, and T22 is less than T1 and greater than T21.

12. The method for defrosting the refrigerator of claim 10, wherein the switching the refrigerator cooling system to enter the partial defrosting mode, and the switching the refrigerator cooling system from the partial defrosting mode to the cooling working mode comprises:

obtaining a second working parameter of the refrigerator cooling system, wherein the preset condition includes that the second working parameter reaches a preset parameter value.

13. The method for defrosting the refrigerator of claim 12, wherein the second working parameter is a temperature parameter t of the evaporator, the preset condition is that t is equal to t1, and t1 is a preset temperature value.

* * * * *